United States Patent [19]

Maier

[11] 4,173,807

[45] Nov. 13, 1979

[54] CLEANING IMPLEMENT

[75] Inventor: Siegfried Maier, Leinfelden-Echterdingen, Fed. Rep. of Germany

[73] Assignee: Dupro AG, Romanshorn, Switzerland

[21] Appl. No.: 919,940

[22] Filed: Jun. 28, 1978

[30] Foreign Application Priority Data

Jun. 29, 1977 [DE] Fed. Rep. of Germany ..... 2729266

[51] Int. Cl.[2] ..... A46B 13/02

[52] U.S. Cl. ..... 15/179; 29/121.5

[58] Field of Search ..... 15/179, 182, 183, 339, 15/364, 366, 392, 41; 1/49 C; 29/121.5

[56] References Cited

U.S. PATENT DOCUMENTS

| | | | |
|---|---|---|---|
| 1,286,321 | 12/1918 | Hoover | 15/179 X |
| 1,401,007 | 12/1921 | Staples | 15/179 X |
| 1,889,224 | 11/1932 | Smellie | 15/179 |
| 2,491,007 | 12/1949 | Koch | 15/366 X |
| 3,104,413 | 9/1963 | Nelson | 29/121.5 X |
| 3,167,802 | 2/1965 | Pratt et al. | 15/366 X |
| 4,042,997 | 8/1977 | McDowell et al. | 15/383 X |

FOREIGN PATENT DOCUMENTS

| | | | |
|---|---|---|---|
| 225673 | 12/1959 | Australia | 15/179 |

*Primary Examiner*—Peter Feldman

*Attorney, Agent, or Firm*—Becker & Becker, Inc.

[57] ABSTRACT

A cleaning implement, especially vacuum cleaner, with a brush for incorporation in a vacuum cleaner nozzle, which has a shaft with bristles mounted at its ends in bearings in an implement housing. In order to restrict penetration of hairs and like foreign bodies, picked up by the bristles, into the bearings, the shaft is provided with at least one transverse circumferential depression. A longitudinal groove is provided so that hairs and threads collected on the shaft can be gathered and cut.

16 Claims, 2 Drawing Figures

CLEANING IMPLEMENT

The invention relates to a cleaning implement, especially vacuum cleaner, with a brush for incorporation in a vacuum cleaner nozzle, which comprises a shaft provided with bristles and having its ends mounted in bearings on a housing of the implement.

Heretofore known cleaning implements of the above mentioned general type have the disadvantage that hairs, threads or similar objects which are removed from the surface to be cleaned are wound round the bristle covered shaft and, due to the rotation of the shaft, are conveyed in the direction of the ends or bearings thereof. As a result, there is a risk that these foreign bodies will also penetrate into the bearings. In order to prevent this, it is known either to close the bearing with a cover disc at the end or to design the bearing as a bushing in which the associated shaft end lies with minimal play. Since there is always a small gap between the bearing disc or the bushing and the roller, it is with these known devices impossible to prevent hairs, threads or the like objects from penetrating into the bearings. Only a relatively small number of hairs or threads are required to block the shaft, so that the implement has to be disassembled in order to remove from the bearing the hairs or threads which have accumulated therein. The disassembly of the implement and the removal of the foreign bodies necessitates a considerable expenditure of work and time and can frequently not be carried out by the operator herself. Also, due to the blockage of the shaft, the driving belt, to which the shaft is connected through a driving motor, or the motor itself may be damaged or even destroyed.

It is, therefore, an object of this invention to provide a cleaning implement of the above mentioned general type with which penetration into the shaft bearings of hairs, threads, or the like objects will be avoided.

Figure 1:
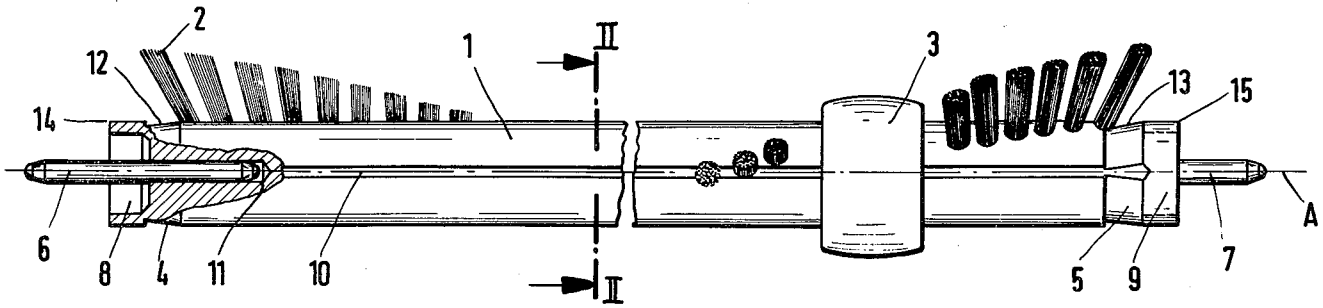
Figure 2:
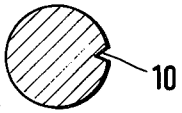

This object and other objects and advantages of the invention will appear more clearly from the following specification in connection with the accompanying drawing, in which:

FIG. 1 is a plan view, and partly a sectional view, of the bristle equipped shaft and pertaining journals, of one form of a cleaning implement according to the invention; and FIG. 2 is a section along the line II—II in FIG. 1.

The cleaning implement according to the invention is characteriszed primarily in that the bristle equipped shaft comprises at least one depression extending transversely in the circumferential direction of the shaft.

With an arrangement of this type, hairs and threads which are wound on the shaft and are conveyed thereon axially to the outside, are collected in the depressions so that it can be prevented that the hairs and threads reach the gap between the shaft and the bearing. By this means, hairs and threads can be prevented in a simple manner and without any special constructionally expensive design of the bearings or the shaft from penetrating into the bearings and from blocking the shaft, which otherwise might cause damage to or even the destruction of the driving belt or the motor.

Referring now to the drawing in detail, the shaft 1 shown in FIG. 1 is provided with bristles 2 and has at its ends journals 6, 7, which are located in central openings 11. The journals 6 and 7 are adapted to be journalled in bearings (not shown) arranged in the housing (not shown) of the implement.

At its end portions 13 and 14, the shaft 1 comprises bearing openings 8 and 9 which are coaxial with its axis A and in which the bearings are arranged in a countersunk manner. In this way, the distance between the end of the bristles and the associated housing inside wall can be kept relatively small, so that the implement length exceeds the working width only to a negligible extent. Uncleaned edge strips are kept relatively small when vacuum cleaning is effected along walls, unshiftable furniture, upholstered furniture, and the like. The diameter of the shaft 1 is preferably less than 20 mm. This dimension allows the tendency of the hairs or threads to loop around the shaft or to wind on the shaft to be kept particularly small. The bristles consist of bristle tufts which are of relatively great length and are arranged around the shaft 1 in a helical manner and at an inclination of 180° with half a rotation; the height of the bristles is approximately equal to the shaft diameter. In this way, the bristles can penetrate relatively deeply into the pile of the carpeting to be cleaned and have a high elasticity, so that the carpeting is treated very gently. Furthermore, due to the high bristle arrangement, the cleaning implement can be prevented from exerting a beating stress on the carpeting.

In the area outside the ends of its bristles, the shaft 1 comprises two annular grooves 4 and 5 which extend to the level of the bottoms of the bearing recesses 8 and 9 and serve as collecting troughs for hairs or threads wound on the shaft 1. Due to the rotary movement of the shaft in the shaft circumferential direction, the threads and hairs are shifted in the direction of the grooves 4 and 5 and are retained therein. The grooves 4 and 5 are coaxial with the axis A of the shaft 1 and have conical groove bottoms 12 and 13. The diameter of the groove 4 tapers in the direction of the associated end 14 of the shaft 1, while the diameter of the groove 5 widens in the direction of the associated end 15 of the shaft 1. Due to this arrangement, it is possible to attain a particularly favorable collecting action and satisfactorily to prevent the penetration of hairs and threads into the bearings.

However, it is also possible for the diameters of the grooves 4 and 5 to be widened in the direction of the center of the shaft 1 or in the direction of the shaft ends. Due to the conical design of the bottoms, the hairs and threads passing into the grooves 4 and 5 are satisfactorily conveyed in the direction of the maximal depth of the grooves, so that the areas of lower depth are free from hairs or threads, thus allowing the groove to receive satisfactorily the hairs and threads that follow.

The same collecting action can also be ensured if the grooves are designed with cylindrical bottoms.

The shaft 1 furthermore comprises a longitudinal groove 10 which extends over the entire length of the shaft 1 as far as the bottom surfaces of the bearing openings 8 and 9. The longitudinal groove 10 is V-shaped in cross section (FIG. 2). In the areas of the annular grooves 4 and 5, the groove 10 widens in a V-like manner in the direction of the ends 14 and 15 of the shaft 1. The maximum depth of the annular grooves 4 and 5 as well as the longitudinal groove 10 is relatively minimal and is only a few millimeters. The longitudinal groove 10 serves for removing the hairs and threads which have accumulated on the shaft 1 or the grooves 4 and 5. To this end, an appropriately bevelled back of a knife blade or scissors is inserted into the groove 10 as far as below the threads and hairs, which are interwined in rings, and is moved along the groove in the direction of the annular grooves 4 and 5, during which process the threads and rings of hair are cut through. The hairs and threads can then be easily removed by hand or by the suction stream. The hairs and threads can be removed particularly easily and quickly from the windened ends of the longitudinal groove 10. It is also possible to provide several longitudinal grooves of equal or different length which are arranged around the shaft 1 in the axial direction or obliquely to the axial direction, for example helically. But, in any event, the longitudinal grooves must end in the annular grooves 4 and 5, so that any hairs and threads accumulated therein can easily be removed.

The shaft 1, furthermore, comprises a running zone 3 with a convex surface. Guided across the running zone 3 is a driving belt (not shown) with the aid of which the shaft 1 is driven by an electric motor (not shown).

It is, of course, to be understood that the present invention is, by no means, limited to the specific showing in the drawing but also encompasses any modifications within the scope of the appended claims.

What I claim is:

1. A rotatable shaft provided with bristles for a cleaning implement, especially vacuum cleaner, and having its ends designed for journalling in bearings, which comprises an annular depression at each end said shaft comprising at least one longitudinal groove extending parallel to the axis of said shaft, said longitudinal groove extending over the entire length of said shaft, including said depressions.

2. A rotatable shaft according to claim 1, in which the ends of said shaft are provided with openings for receiving the bearings for said shaft.

3. A rotatable shaft according to claim 2, in which said depressions are axially adjacent to said openings in the ends of said shaft.

4. A rotatable shaft according to claim 3, in which the depressions are coaxial to the axis of said shaft.

5. A rotatable shaft according to claim 3, in which the bottom of at least one depression is of cylindrical design.

6. A rotatable shaft according to claim 3, in which the bottom of at least one depression is of conical design.

7. A rotatable shaft according to claim 1, in which at least one depression tapers in the direction of the associated end of said shaft.

8. A rotatable shaft according to claim 1, in which at least one depression widens in the direction of the associated end of said shaft.

9. A rotatable shaft according to claim 8, in which one depression tapers in diameter in the direction of the associated end of said shaft whereas the other depression widens in the direction of the associated end of said shaft.

10. A rotatable shaft according to claim 1, at least one depression is V-shaped in cross section.

11. A rotatable shaft according to claim 1, in which at least one depression widens axially to the outside.

12. A rotatable shaft according to claim 1, in which the diameter of said shaft is smaller than 20 mm.

13. A rotatable shaft according to claim 1, in which the maximum bristle length of said shaft approximately equals the length of the diameter of said shaft.

14. A rotatable shaft according to claim 1, in which said shaft comprises approximately in its axially external quarter a running surface for a driving belt.

15. A rotatable shaft according to claim 14, in which said running surface is coaxial with said shaft and is of convex design.

16. A rotatable shaft according to claim 1, in which the end areas of said shaft are provided with axially extending bores having journals inserted therein projecting beyond said end areas, the axes of said journals being in axial alignment with the axis of said shaft.

* * * * *